United States Patent [19]

Grass

[11] Patent Number: 4,834,556

[45] Date of Patent: May 30, 1989

[54] GUIDE RAIL OR RUNNER FOR DRAWERS OR LIKE

[75] Inventor: Alfred Grass, Höchst, Austria

[73] Assignee: Alfred Grass Ges.m.b.H. Metallwarenfabrik, Höchst, Austria

[21] Appl. No.: 165,631

[22] Filed: Mar. 8, 1988

[30] Foreign Application Priority Data

Apr. 6, 1987 [DE] Fed. Rep. of Germany ... 8705102[U]

[51] Int. Cl.[4] ..... F16C 29/02

[52] U.S. Cl. ..... 384/22; 384/41

[58] Field of Search ..... 384/22, 20, 21, 23, 384/41; 312/341 R

[56] References Cited

U.S. PATENT DOCUMENTS 4,141,525 2/1979 Miller ..... 384/22

4,555,147 11/1985 Jackson ..... 384/19

*Primary Examiner*—Lenard A. Footland

[57] ABSTRACT

A guide rail for drawers or the like is attachable to a sidewall of a piece of furniture. The guide rail has a row of first fastening apertures arranged along the longitudinal axis of the rail and mutually spaced so as to correspond to a pattern of drillings in the sidewall, which pattern conforms to a first, European system. The rail also has a row of second fastening apertures having a spacing conforming to a second, United States system. The rows of fastening apertures conforming to the first system and to the second system are situated in a common horizontal plane in one embodiment of the invention, with the apertures in one row intersecting the apertures in the other row. The two rows, or at least the foremost fastening apertures thereof, are disposed relative to the forward end of the guide rail so that, irrespective of whether the rail is attached to a sidewall of a piece of furniture via drillings therein conforming to the European system or to the United States system, the required positioning of the rail relative to the front edge of the sidewall will be achieved.

2 Claims, 1 Drawing Sheet

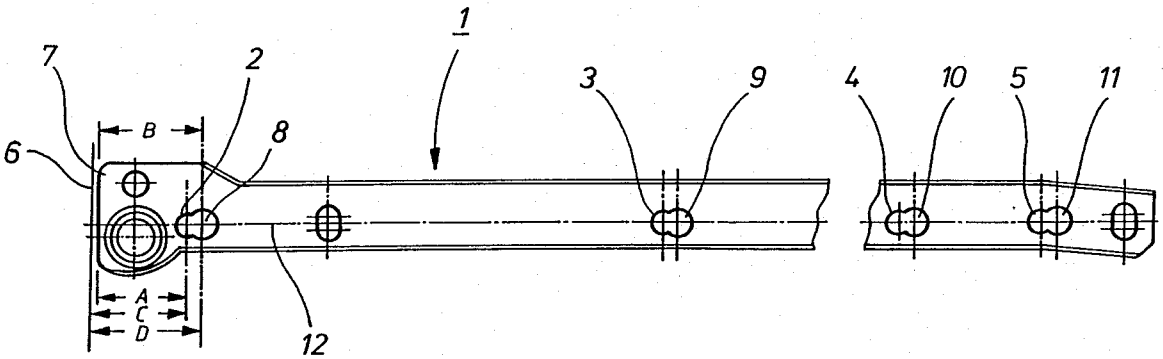
1
2
3
4
5
6
7
8
9
10
11
12
A
B
C
D

GUIDE RAIL OR RUNNER FOR DRAWERS OR LIKE

BACKGROUND OF THE INVENTION

The invention relates to a guide rail or runner for drawers or the like, which for the purpose of attachment to the sidewall of a piece of furniture has several fastening bores or apertures arranged along the longitudinal axis of the rail and having a mutual spacing corresponding to a grid or pattern of bores or apertures in the piece of furniture. The fastening aperture disposed closest to the forward end extremity of the guide rail is situated at a distance corresponding to that employed in Europe, i.e. as laid down by the "Euro-system", from the said forward end of the rail, and thus from the front edge of the sidewall when the rail is assembled to the sidewall.

Based on a known guide rail of this kind, this invention has the fundamental problem of providing a rail intended for universal application in accordance with the aperture grid or pattern conforming to the Euro-system, as well as to that employed in the U.S.A., appropriate for installation on the sidewall of the piece of furniture in question.

BRIEF SUMMARY OF THE INVENTION

The solution to this problem is that, in addition to the fastening apertures or bores of the Euro-system which include the foremost aperture situated adjacent, for example, 30 mm. from, the forward end of the guide rail, the guide rail also has formed in it a second row of fastening apertures or bores corresponding to the U.S. pattern of apertures, of which the fastening aperture lying closest to the forward end of the guide rail is spaced from the forward end by a distance corresponding to that laid down by the U.S. system, for example by 35 mm. from the said forward end, or rather by 37 mm. from the front edge of the sidewall of the furniture in the assembled state.

So that a guide rail may be provided which is universally applicable to both systems of aperture grids or patterns without having to be made excessively wide to accommodate the two rows of fastening apertures which have to be incorporated, the rows of fastening apertures for both systems may be situated in a common horizontal plane and be produced as intersecting apertures in the form of a double-aperture.

To accommodate the different diameter screws, etc., to be utilised for the different systems, the fastening apertures appertaining to the two systems will have respective appropriate diameters so that the double aperture in each case will have two different diameters.

Although the fastening apertures may be produced by means of a drilling machine in a prefabricated guide rail, which may also appropriately countersink the apertures for reception of the countersunk heads of fastening screws, the fastening apertures appertaining to both systems may be formed in other ways, for example, punched out whilst stamping the guide rail, and provided with the countersinks to receive the countersunk heads of the fastening screws.

What is essential is that a guide rail for drawers or the like, in accordance with this invention, should be capable of being utilised in an universal and interchangeable manner for the aperture grids in the sidewalls of pieces of furniture complying with the Euro-system as well as the U.S. systems, with the distance of the forward end of the guide rail from the front edge of the sidewall of being assured in either case.

BRIEF DESCRIPTION OF THE DRAWINGS

Further objects and advantages of this invention will become apparent from the following detailed description taken in conjunction with the accompanying drawing, in which the single FIGURE is a side elevation of a guide rail or runner for a drawer or the like, according to one embodiment of the invention.

DETAILED DESCRIPTION OF THE PREFERRED EMBODIMENT

The single FIGURE shows a guide rail or runner 1 for attachment to the left-hand sidewall of the body of a compartment of a chest of drawers. The guide rail 1 for the right-hand sidewall of said body will be appropriately produced in laterally inverted, reversed or mirror-image form.

In the illustrated embodiment, the fastening apertures or aperture portions 2, 3, 4 and 5 of one system lie in a horizontal plane 12 which is common or adjacent to that of the fastening apertures or aperture portions 9, 10 and 11 of the other system, with the two sets of apertures intersecting to form double apertures. The apertures may be formed by a drilling machine in a prefabricated guide rail, or may be simultaneously pressed or punched out during the process of forming the guide rail.

The fastening apertures 2 and 8 lying closest to the forward side end 7 of the guide rail 1 are decisive in each case for positioning the guide rail 1 with respect to the front edge 6 of the body of the piece of furniture, in the assembled state. The grid spacing for the apertures or boreholes in the sidewall of said body, to which the guide rail 1 is to be attached by means of screws, provides spacings C and D respectively for the first and second drillings, closest to the front end of the rail, from the front edge 6 of said body. In the illustrated embodiment, the spacing C amounts to 32 mm. for the Euro-system, and 37 mm. for the system used in USA. If the spacing established by the guide rail system between the forward side end 7 of the guide rail 1 and the front edge 6 of the body is adhered to, the result will be that there will be a spacing A of 30 mm. for one system, and a spacing B of 35 mm. for the other system, at which the respective first and second fastening apertures 2 and 8, closest to the forward side end 7 of the guide rail 1 are situated.

As will be apparent from the FIGURE, the fastening apertures are in each case produced to intersect each other in pairs, i.e. 2/8, 3/9, 4/10 and 5/11, to form double apertures, similar in outline to keyhole slots, since the fastening apertures 8, 9, 10 and 11 have a larger diameter than the fastening apertures 2, 3, 4 and 5, so as to accommodate the corresponding fastening screws to be utilised.

All the fastening apertures are provided with countersinks, which are formed therein during the drilling or punching operation.

As will be apparent, the illustrated embodiment provides a guide rail, and therefore a guide rail system, for drawers or the like, which is compatible with the European grid as well as with the US grid, so that an adaptation of the drillings in the sidewalls of the bodies of pieces of furniture to one grid system or the other is thereby eliminated.

What is claimed is:

1. A guide rail for a drawer or the like having a forward end and being adaptable for securement to a Euro-system and a U.S. system aperture pattern in the supporting wall, the rail comprising: a row of first fastening apertures arranged along the longitudinal axis of the rail and mutually spaced so as to correspond to a Euro-system pattern of apertures in the wall to enable the rail to be attached to the wall, said pattern of apertures having a first fastening aperture disposed proximate the forward end of the guide rail at a distance corresponding to a first Euro-system fastening aperture near the forward end of the rail and the front edge of the wall when the rail is secured thereto; a row of second fastening apertures arranged along the longitudinal axis of the rail and corresponding to a U.S. system pattern of apertures said pattern of apertures having the second fastening aperture disposed proximate for forward end of the guide rail at a distance corresponding to a first U.S. system fastening aperture near the forward end of the rail and the front edge of the wall when the rail is secured thereto, said first and second rows of fastening apertures being situated in a common horizontal plane, the apertures in said first row intersecting corresponding apertures in said second row to form associated double-apertures, the fastening apertures in said second row having larger diameters than the diameters of the fastening apertures in said first row.

2. A guide rail according to claim 1 wherein the fastening apertures are formed during stamping and are provided with countersinks; and further comprising fastening screws having countersunk heads corresponding to said countersinks to be used to attach the rail to a wall.

* * * * *